US008175488B2

(12) United States Patent
Iwata et al.

(10) Patent No.: US 8,175,488 B2
(45) Date of Patent: May 8, 2012

(54) IMAGE FORMING APPARATUS AND IMAGE FORMING METHOD INCLUDING TRANSPORTING DEVELOPER USING AN AIRFLOW GENERATOR

(75) Inventors: Nobuo Iwata, Sagamihara (JP); Junichi Matsumoto, Yokohama (JP); Natsumi Katoh, Atsugi (JP); Tomoya Ohmura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 332 days.

(21) Appl. No.: 12/256,998

(22) Filed: Oct. 23, 2008

(65) Prior Publication Data

US 2009/0123174 A1 May 14, 2009

(30) Foreign Application Priority Data

Nov. 8, 2007 (JP) ..... 2007-291262

(51) Int. Cl.
*G03G 21/20* (2006.01)
*G03G 15/08* (2006.01)

(52) U.S. Cl. ..... 399/92; 399/258; 399/292; 399/254

(58) Field of Classification Search ..... 399/92, 399/94, 97
See application file for complete search history.

(56) References Cited

U.S. PATENT DOCUMENTS 5,561,506 A * 10/1996 Kasahara ..... 399/256
6,526,246 B2 2/2003 Iwata et al.
6,542,707 B2 4/2003 Muramatsu et al.
6,571,076 B2 5/2003 Kasahara et al.
6,597,883 B2 7/2003 Muramatsu et al.
6,628,908 B2 9/2003 Matsumoto et al.
6,628,913 B2 9/2003 Matsumoto et al.
6,628,915 B2 9/2003 Muramatsu et al.
6,785,496 B2 8/2004 Iwata et al.
6,826,381 B2 11/2004 Muramatsu et al.
6,871,034 B2 3/2005 Muramatsu et al.
6,882,812 B2 4/2005 Kasahara et al.
6,898,405 B2 5/2005 Matsumoto et al.
7,043,179 B2 5/2006 Matsumoto et al.
7,065,313 B2 6/2006 Matsumoto et al.
7,076,191 B2 7/2006 Muramatsu et al.
7,085,522 B2 8/2006 Muramatsu et al.
7,088,945 B2 8/2006 Matsumoto et al.
7,103,305 B2 9/2006 Koike et al.
7,116,928 B2 10/2006 Muramatsu et al.
7,127,198 B2 10/2006 Muramatsu et al.
7,130,558 B2 10/2006 Matsumoto et al.
7,209,689 B2 4/2007 Matsumoto et al.
(Continued)

FOREIGN PATENT DOCUMENTS

JP 8-123199 5/1996
(Continued)

*Primary Examiner* — David Gray
*Assistant Examiner* — David Bolduc
(74) *Attorney, Agent, or Firm* — Oblon, Spivak, McClelland, Maier & Neustadt, L.L.P.

(57) ABSTRACT

An image forming apparatus and method for developing a latent image on an image bearing member includes the image bearing member, an air flow generator, and an air intake device. The image bearing member is configured to bear the latent image on the surface thereof. The airflow generator is configured to generate airflow to transport a developer. The air intake device is configured to connect outside the image forming apparatus with the airflow generator to draw air from outside the image forming apparatus to supply the air to the airflow generator.

15 Claims, 5 Drawing Sheets

U.S. PATENT DOCUMENTS

| | | | | |
|---|---|---|---|---|
| 7,221,891 | B2 | 5/2007 | Matsumoto et al. | |
| 7,245,853 | B2 | 7/2007 | Muramatsu et al. | |
| 7,257,348 | B2 | 8/2007 | Matsumoto et al. | |
| 7,277,664 | B2 | 10/2007 | Katsuyama et al. | |
| 7,289,748 | B2 | 10/2007 | Yanagisawa et al. | |
| 7,346,286 | B2 | 3/2008 | Matsumoto et al. | |
| 7,346,299 | B2 | 3/2008 | Muramatsu et al. | |
| 7,356,288 | B2 | 4/2008 | Iwata et al. | |
| 7,356,290 | B2 | 4/2008 | Matsumoto et al. | |
| 7,406,278 | B2 | 7/2008 | Katsuyama et al. | |
| 7,489,891 | B2 * | 2/2009 | Tomita | 399/252 |
| 7,522,857 | B2 * | 4/2009 | Hasegawa et al. | 399/109 |
| 2002/0009310 | A1 * | 1/2002 | Kabumoto et al. | 399/258 |
| 2002/0098015 | A1 * | 7/2002 | Zalewski | 399/237 |
| 2003/0156859 | A1 | 8/2003 | Tamai | |
| 2003/0235436 | A1 | 12/2003 | Kasahara et al. | |
| 2005/0265759 | A1 | 12/2005 | Takeuchi et al. | |
| 2005/0281592 | A1 | 12/2005 | Muramatsu et al. | |
| 2006/0251983 | A1 | 11/2006 | Muramatsu et al. | |
| 2007/0009289 | A1 | 1/2007 | Muramatsu et al. | |
| 2007/0053721 | A1 | 3/2007 | Matsumoto et al. | |
| 2007/0053723 | A1 | 3/2007 | Iwata et al. | |
| 2007/0065183 | A1 * | 3/2007 | Tomita | 399/258 |
| 2007/0154242 | A1 * | 7/2007 | Matsumoto et al. | 399/254 |
| 2007/0166079 | A1 | 7/2007 | Ichikawa et al. | |
| 2007/0189813 | A1 | 8/2007 | Matsumoto et al. | |
| 2007/0264053 | A1 * | 11/2007 | Iwata et al. | 399/254 |
| 2007/0274740 | A1 | 11/2007 | Katoh et al. | |
| 2008/0038019 | A1 | 2/2008 | Kasahara et al. | |
| 2008/0050145 | A1 * | 2/2008 | Hanano | 399/93 |
| 2008/0069596 | A1 | 3/2008 | Katsuyama et al. | |

FOREIGN PATENT DOCUMENTS

| | | | |
|---|---|---|---|
| JP | 10293452 | A * | 11/1998 |
| JP | 3349286 | | 9/2002 |
| JP | 3391926 | | 1/2003 |

* cited by examiner

IMAGE FORMING APPARATUS AND IMAGE FORMING METHOD INCLUDING TRANSPORTING DEVELOPER USING AN AIRFLOW GENERATOR

CROSS-REFERENCE TO RELATED APPLICATIONS

This patent application is based on and claims priority pursuant to 35 U.S.C. §119 from Japanese Patent Application No. 2007-291262 filed on Nov. 8, 2007 in the Japan Patent Office, the entire contents of which are hereby incorporated herein by reference.

BACKGROUND OF THE INVENTION

1. Field of the Invention

Exemplary aspects of the present invention generally relate to an image forming apparatus, such as a copier, a facsimile machine, or a printer, and more particularly, to an image forming apparatus that transports developer using a flow of air, and a method for developing a latent image on an image bearing member with developer.

2. Description of the Background Art

In general, image forming apparatuses, such as printers, facsimile machines, and copiers, that form an image using an image bearing member, are equipped with a developing device to develop a latent image on the image bearing member with a developer, examples of which are disclosed in Japanese Patent Unexamined Application Publication No. Hei08-123199, Japanese Patent No. 3349286, and Japanese Patent No. 3391926.

However, in such a related art developing device, a rise in temperature of the developer may cause characteristics of the developer to change, in particular causing reduction in its fluidity and developability, and accumulation of developer particles and so forth that ultimately leading to deterioration of imaging quality.

Generally, the temperature of the developer in the developing device is most likely to rise due to frictional heat generated during agitation of the developer, contact of the developer with other components, and/or eddy current generated when a developing sleeve rotates around a magnet at a relatively high speed.

Further, a light source, a fixing device, and other components, including a motor, for example, generate heat in the image forming apparatus, also causing the temperature of the developer to rise.

This problem of heat generation and its effects on the characteristics of the developer are particularly acute in the case of methods for transporting the developer involves using a flow of air (hereinafter "airflow). For example, Japanese Patent Unexamined Application Publication No. Hei08-123199 discloses a developing device that transports a developer using airflow. When transporting the developer using airflow as disclosed in the related art, air is circulated in the image forming apparatus so as to facilitate transport of the developer.

According to this related-art approach, with a relatively simple structure it is possible to transport the developer to relatively distant locations through selectable paths.

However, a drawback to this technique is that the light source, the fixing device, and other heat-generating components including the motor cause undesirable heating of the air being circulated, thus raising the temperature of the developer transported by airflow.

SUMMARY OF THE INVENTION

Illustrative embodiments of the present invention provide an image forming apparatus and a method for developing a latent image on an image bearing member with developer.

According to one preferred embodiment, the image forming apparatus includes the image bearing member, an airflow generator, and an air intake device. The image bearing member is configured to bear the latent image on the surface thereof. The airflow generator is configured to generate airflow to transport a developer. The air intake device is configured to connect outside the image forming apparatus with the airflow generator to draw air from outside the image forming apparatus to supply the air to the airflow generator.

According to another preferred embodiment, the method for developing a latent image on an image bearing member with a developer includes bearing a latent image on a surface of an image bearing member, generating airflow to transport a developer, and drawing air from outside an image forming apparatus by connecting outside the image forming apparatus with the generating the airflow.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
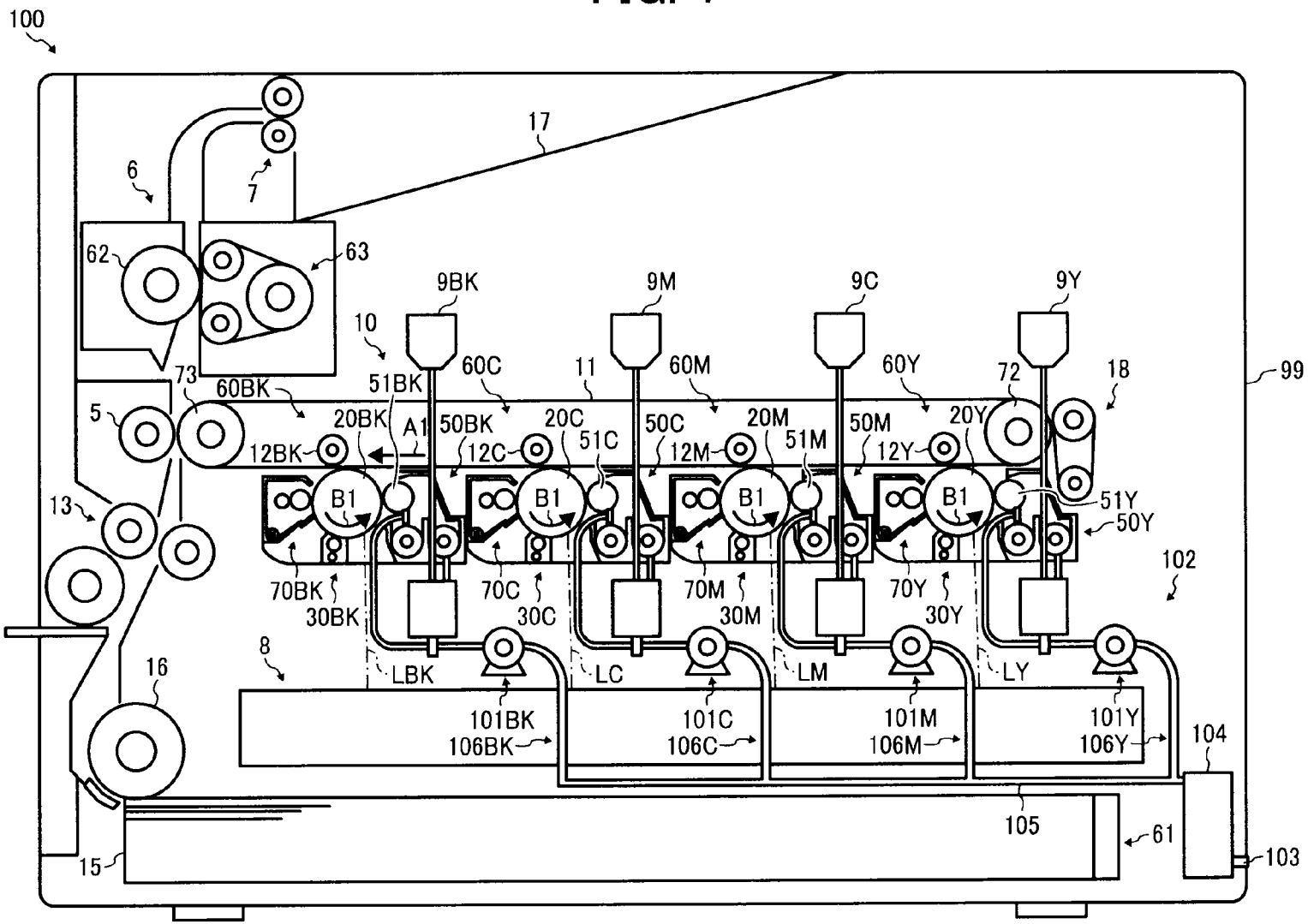
FIG. 1 is a schematic diagram illustrating a multi-functional color system as an example of an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus, for example, a multi-functional color system, according to an illustrative embodiment of the present invention is described.

FIG. 1 is a schematic diagram illustrating a multi-functional color system (hereinafter simply referred to as an image forming apparatus) as one example of an image forming apparatus for producing color images.

In FIG. 1, the image forming apparatus 100 according to the illustrative embodiment is a multi-functional system including a color laser printer and a facsimile. Alternatively, the image forming apparatus 100 may be a multi-functional system including a color laser printer and a facsimile, or a multi-functional system including other types of printers, facsimile machines, copiers, or a combination of a copier and a printer, and so forth.

The image forming apparatus 100 receives image information from an external device, such as a PC and forms an image based on image signals corresponding to the image information. The similar or the same image forming process is employed when the image forming apparatus 100 is used as a facsimile.

The image forming apparatus 100 can form an image on a sheet-type recording medium such as a normal paper sheet that is generally used for copying, a relatively thick sheet such as an OHP sheet, a card, a postcard, or the like, and an envelope.

The image forming apparatus 100 is a tandem-type image forming apparatus including a plurality of latent image bearing members arranged in tandem that forms images in colors of yellow, magenta, cyan, and black. The image forming apparatus 100 includes cylindrical photoreceptor drums 20Y, 20M, 20C, and 20BK, each of which serves as the latent image bearing member arranged next to each other.

The image forming apparatus 100 also includes an image forming stations 60Y, 60M, 60C, and 60BK, each of which serves as an image forming device. It is to be noted that reference characters Y, M, C, and BK denote colors yellow, magenta, cyan, and black, respectively.

Each of the photoreceptor drums 20Y, 20M, 20C, and 20BK has the same diameter and is provided, equally spaced on an outer surface of a transfer belt 11, that is, a surface on which an image is formed. The transfer belt 11 is an endless belt serving as an intermediate transfer belt disposed in substantially the center of a main structure 99 of the image forming apparatus 100.

The photoreceptor drums 20Y, 20M, 20C, and 20BK are arranged in this order from upstream of a traveling direction of the transfer belt 11 indicated by arrow A1 in FIG. 1. The photoreceptor drums 20Y, 20M, 20C, and 20BK are provided to the image forming stations 60Y, 60M, 60C, and 60BK, respectively, so as to form images in yellow, magenta, cyan, and black.

Visible images, that is, toner images, formed on the respective color of the photoreceptor drums 20Y, 20M, 20C, and 20BK, are transferred overlappingly onto the transfer belt 11 traveling in the direction of arrow A1, thereby forming a composite toner image. Subsequently, the composite toner image is transferred onto a transfer medium (a recording medium).

Primary transfer rollers 12Y, 12M, 12C, and 12BK, each of which serves as a transfer charger, are disposed facing the photoreceptor drums 20Y, 20M, 20C, and 20BK sandwiching the transfer belt 11 therebetween.

The photoreceptor drums 20Y, 20M, 20C, and 20BK are supplied with a voltage by the primary transfer rollers 12Y, 12M, 12C, and 12BK from upstream to downstream in the direction of arrow A1 with a different timing such that the toner images of yellow, magenta, cyan, and black formed on the photoreceptor drums 20Y, 20M, 20C, and 20BK are transferred overlappingly at the same position (a transfer position) on the transfer belt 11.

The transfer belt 11 is formed of an elastic belt including a plurality of layers, all of which may be formed of elastic material. Alternatively, the transfer belt 11 may be an elastic belt having a single layer, or some or an entire of which is formed of elastic material. The transfer belt 11 may include fluorine resin, polycarbonate resin, polyimide resin, or the like. Still further, the transfer belt 11 may be of a non-elastic belt.

In the image forming apparatus 100, a transfer belt unit 10 equipped with the transfer belt 11 is provided substantially above the four image forming stations 60Y, 60M, 60C, and 60BK, also the photoreceptor drums 20Y, 20M, 20C, and 20BK.

A secondary transfer roller 5 serving as a transfer member is provided facing and contacting the transfer belt 11. The secondary transfer roller 5 is configured to rotate in the same direction as that of the transfer belt 11 at a contact position where the secondary transfer roller 5 contacts the transfer belt 11.

The image forming apparatus 100 includes a cleaning device 18 and an optical scanner 8. The cleaning device 18 is disposed across from the transfer belt 11 and includes a cleaning brush that cleans the surface of the transfer belt 11.

The optical scanner 8 serves as a writing device and is disposed at substantially the bottom of the image forming stations 60Y, 60M, 60C, and 60BK facing the image forming stations 60Y, 60M, 60C, and 60BK.

The image forming apparatus 100 includes a sheet feeder 61, a pair of registration rollers 13, and a detector, not shown.

The sheet feeder 61 stores transfer sheets to be transported between the photoreceptor drums 20Y, 20M, 20C and 20BK, and the transfer belt 11. The pair of registration rollers 13 sends the transfer sheet transported from the sheet feeder 61 to a transfer portion between the transfer belt 11 and the secondary transfer roller 5 in an appropriate timing such that the transfer sheet is aligned with the toner image formed in the image forming stations 60Y, 60M, 60C, and 60BK. The detector detects arrival of a leading edge of the transfer sheet at the registration rollers 13.

The image forming apparatus 100 includes a fixing device 6, a discharge roller 7, a catch tray 17, and toner bottles 9Y, 9M, 9C, and 9BK.

The fixing device 6 is a belt-type fixing device that fixes the toner image transferred onto the transfer sheet. The discharge roller 7 discharges the transfer sheet after being fixed by the fixing device 6 outside the main structure 99. The transfer sheet discharged outside the main structure by the discharge roller 7 is stacked on the catch tray 17. The toner bottles 9Y, 9M, 9C, and 9BK serve as toner hoppers filled with toners of yellow, cyan, magenta, and black, respectively.

The image forming apparatus 100 includes storage media such as a CPU, a ROM, and a RAM, and a controller that controls operation of the image forming apparatus 100.

The transfer belt unit 10 includes, in addition to the transfer belt 11, the primary transfer rollers 12Y, 12M, 12C, and 12BK, a driving roller 73 serving as a driving member, and a driven roller 72.

The transfer belt 11 is wound around the driving roller 73 and the driven roller 72. The driving roller 73 is rotated by a motor serving as a drive source, not shown, thereby rotating the transfer belt 11 in the direction of arrow A1.

The fixing device 6 includes a fixing member 63 and a pressure roller 62. The fixing member 63 includes a heat source, not shown. The pressure roller 62 is configured to contact and press against the fixing member 63. The transfer sheet bearing the toner image thereon passes through a fixing portion where the fixing member 63 and the pressure roller 62 press each other, thereby applying heat and pressure to the transfer sheet. Accordingly, the toner image borne on the transfer sheet is fixed thereto.

The optical scanner 8 is configured to illuminate and scan the surface of the photoreceptor drums 20Y, 20M, 20C, and 20BK with laser beams LY, LM, LC, and LBK based on the image signal for forming an electrostatic latent image.

The sheet feeder 61 includes a sheet feed tray 15 and a sheet feed roller 16. The sheet feed tray 15 stores the transfer sheet(s). The sheet feed roller 16 is configured to pick up and send the transfer sheet(s) stacked on the sheet feed tray 15.

A description will be now provided of the image forming station 60Y as a representative example of the image forming stations 60Y, 60M, 60C, and 60BK. The image forming stations 60Y, 60M, 60C, and 60BK have the same configuration, deferring only in the color of toner employed. It is to be noted that reference characters Y, M, C, and BK denote colors yellow, magenta, cyan and black, respectively.

The image forming station 60Y equipped with the photoreceptor drum 20Y includes the primary transfer roller 12Y, a cleaning device 70Y, a charging device 30Y, and a developing station 50Y, each of which is disposed around the photoreceptor drum 20Y in a counterclockwise direction indicated by arrow B1 in FIG. 1.

The cleaning device 70Y is configured to clean the photoreceptor drum 20Y. The charging device 30Y serving as a charging mechanism is configured to charge the photoreceptor drum 20Y to a high voltage. The developing station 50Y is configured to develop the photoreceptor drum 20Y.

The photoreceptor drum 20Y, the cleaning device 70Y, the charging device 30Y, the developing station 50Y are integrally provided, constituting an integrated process cartridge. Further, the process cartridge is detachably mountable relative to the main structure 99 so that the process cartridge can be replaced with ease, facilitating maintenance.

With the above-described configuration, while rotating in the direction of arrow B1, the surface of the photoreceptor drum 20Y is charged evenly by the charging device 30Y. When the optical scanner 8 exposes the photoreceptor drum 20Y with the laser beam LY, an electrostatic latent image corresponding to a color of yellow is formed thereon.

The electrostatic latent image is formed on the photoreceptor drum 20Y, as the laser beam LY scans the surface thereof in the vertical direction of the transfer sheet which is equivalent to a main scan direction, and also scans in a sub-scan direction equivalent to a circumferential direction of the photoreceptor drum 20Y while the photoreceptor drum 20Y rotates in the direction of arrow B1.

The charged yellow toner supplied by the developing station 50Y adheres to the electrostatic latent image formed in a manner described above so that the electrostatic latent image is developed to a visible image (toner image) of yellow.

Subsequently, the obtained toner image of yellow is primarily transferred onto the transfer belt 11 traveling in the direction of arrow A1 by the primary transfer roller 12Y.

After transfer, the toner remaining on the photoreceptor drum 20Y is removed and recovered by the cleaning device 70 in preparation for subsequent charging by the charging device 30Y for the subsequent imaging cycle.

Similar to the photoreceptor drum 20Y, toner images of cyan, magenta, and black are formed on the photoreceptor drums 20C, 20M, and 20BK, respectively, and are transferred primarily and overlappingly at the same position on the transfer belt 11 traveling in the direction of arrow Al by the primary transfer rollers 12C, 12M, and 12BK.

When the transfer belt 11 travels in the direction of arrow A1, the composite toner image on the transfer belt 11 moves to a secondary transfer position facing the secondary transfer roller 5. Subsequently, the composite toner image is transferred secondarily onto the transfer sheet at the secondary transfer position.

The transfer sheet is fed from the sheet feeder 61 and sent between the transfer belt 11 and the secondary transfer roller 5 by the pair of the registration rollers 13 in an appropriate timing based on a detection signal of the detector such that the leading end of the toner image on the transfer belt 11 comes to face the secondary transfer roller 5.

When the multiple-color composite toner image is transferred onto the transfer sheet, the transfer sheet advances to the fixing device 6. Subsequently, when the transfer sheet passes the fixing position between the fixing unit 63 and the pressure roller 62, the toner image borne on the transfer sheet is fixed thereon by heat and pressure. Through this fixing process, a composite color image (hereinafter referred to as a color image) is formed on the transfer sheet.

After passing the fixing device 6, the transfer sheet, on which the toner image is fixed, is stacked on the sheet discharge tray 17 via the sheet discharge roller 7.

After the secondary transfer process, the transfer belt 11 is cleaned by the cleaning device 18 in preparation for the subsequent primary transfer process.

In the image forming apparatus 100, the developing stations 50Y, 50M, 50C, and 50BK have substantially the same configuration, differing only in the color of toner employed. Therefore, to simplify the description, the reference characters Y, M, C, and BK indicating colors are omitted herein. Thereafter, the developing stations 50Y, 50M, 50C, and 50BK are described as the developing station 50, and similarly, the photoreceptor drums 20Y, 20M, 20C, and 20BK are described as the photoreceptor drum 20. The toner bottles 9Y, 9M, 9C, and 9BK are described as the toner bottle 9.

Figure 2:
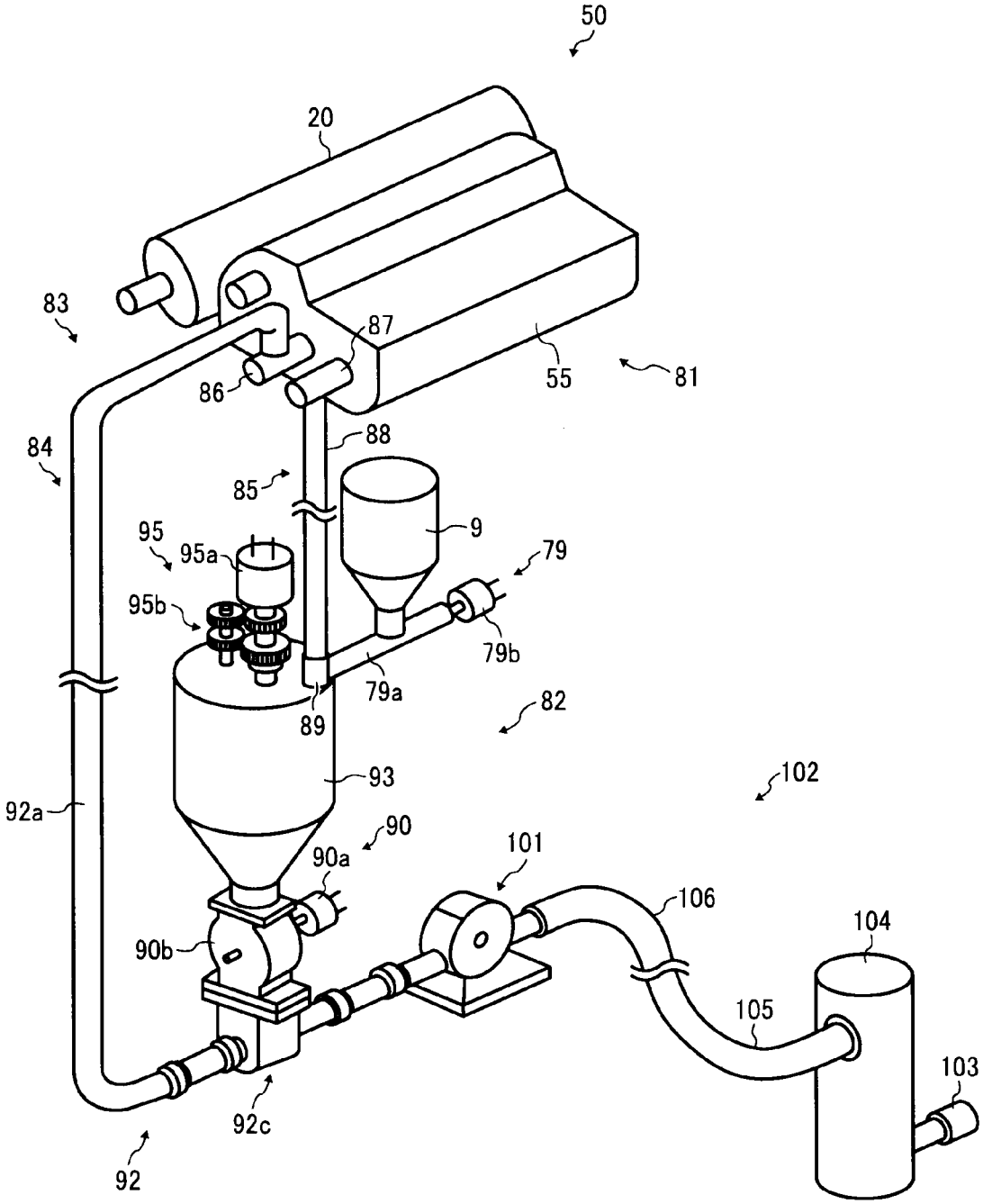
FIG. 2 is a schematic perspective view illustrating a developing station in the image forming apparatus of FIG. 1 according to an illustrative embodiment of the present invention.

Referring now to FIG. 2, there is provided a perspective view illustrating the developing station 50 of the image forming apparatus 100, according to the illustrative embodiment.

The developing station 50 is disposed facing the photoreceptor drum 20, and includes a developing device 81, an agitation unit 82, a reflux device 83, and a toner supply device 79.

Figure 3:
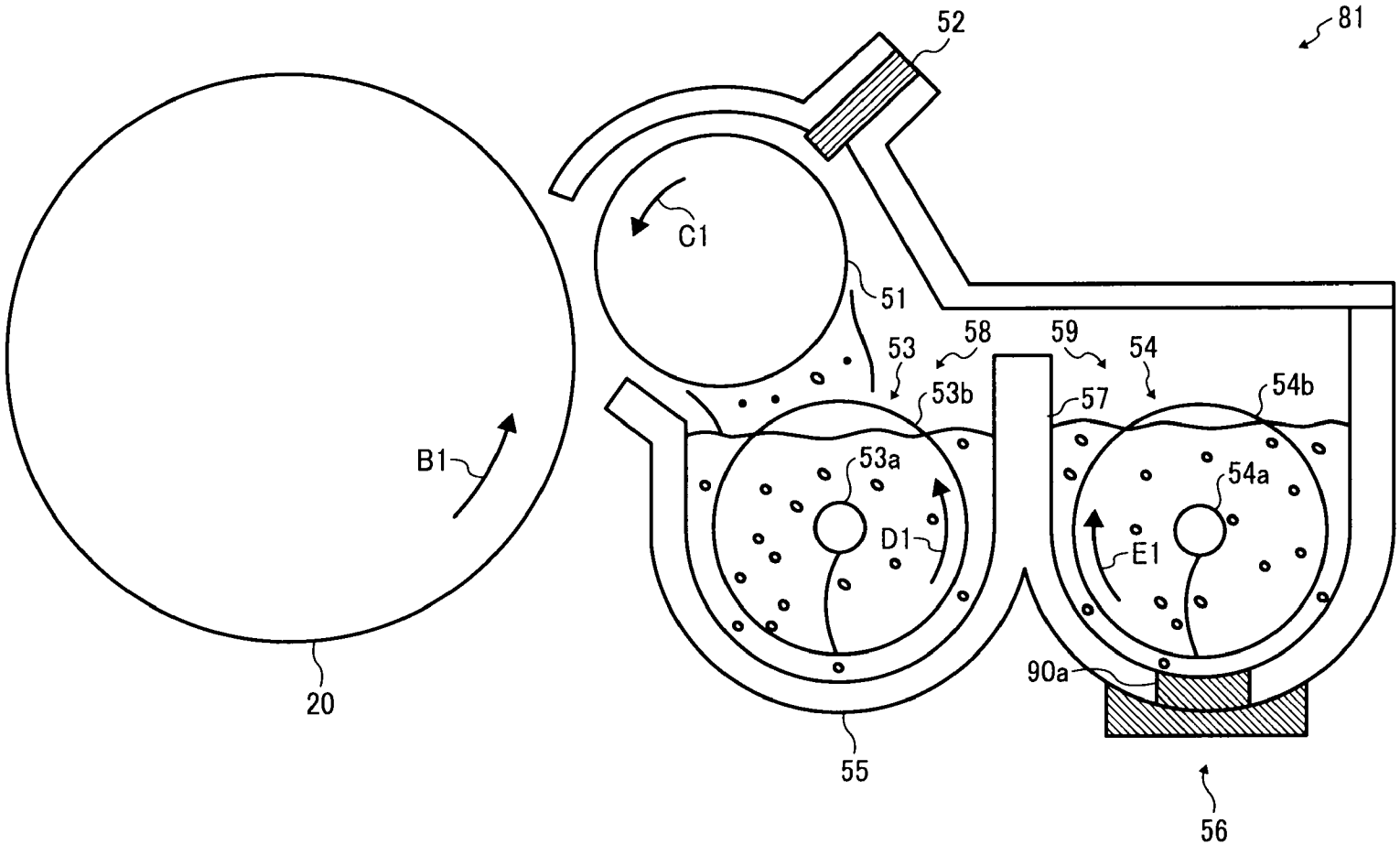
FIG. 3 is a cross-sectional view illustrating a developing device of the developing station of FIG. 2 according to an illustrative embodiment of the present invention.

With reference to FIG. 3, the developing device 81 includes the developing roller 51 serving as a developer bearing member that bears a dry-type two-component developer including toner and carrier (hereinafter simply referred to as the developer).

Referring back to FIG. 2, the agitation unit 82 is configured to agitate the developer to be supplied to the developing device 81.

As illustrated in FIG. 2, the agitation unit 82 includes an agitation device 93, a reduction gear array 95*b*, and a motor 95*a*.

The agitation device 93 is configured to agitate the developer inside thereof. The reduction gear array 95*b* is disposed substantially above the agitation device 93. The motor 95*a* is configured to rotate the reduction gear array 95*b*.

The reflux device 83 is configured to circulate the developer by refluxing the developer between the developing device 81 and the agitation unit 82.

The toner bottle 9 is detachably mountable to the toner supply device 79 serving as a toner supply mechanism. The toner supply device 79 is configured to supply a fresh toner from the toner bottle 9 to the agitation unit 82.

As described above, the developing station 50 is a detachable developing station capable of agitating the developer.

The reflux device 83 includes a homeward path 84 and an outward path 85. The homeward path 84 constitutes a first channel-forming device for forming a channel that directs the developer from the agitation unit 82 to the developing device 81. The outward path 85 constitutes a second channel-forming device for forming a channel that directs the developer from the developing device 81 to the agitation unit 82.

As illustrated in FIG. 3, the developing device 81 includes the developing roller 51, a casing 55 and a developing blade 52. An opening is provided to the casing 55 at a location facing the photoreceptor drum 20, such that a portion of the developing roller 51 is exposed to the photoreceptor drum 20.

The developing blade 52 is supported by the casing 55 and configured to regulate the thickness of the developer borne on the developing roller 51.

The developing device 81 includes a toner density detector 56, a bias applicator, not shown, a developing roller drive mechanism, not shown, a conveyance screw drive mechanism, not shown, and so forth.

The toner density detector 56 serves as a toner density detection mechanism and is configured to measure the toner density of the developer. The developing roller drive mechanism drives the developing roller 51. The conveyance screw drive mechanism rotates a first conveyance screw 53 and a second conveyance screw 54.

The toner density detector 56 detects the toner density. The detection result is input to the controller. Operation of the bias applicator, the developing roller drive mechanism, and the conveyance drive mechanism is controlled by the controller.

The developing roller 51 is extendedly provided in a direction perpendicular to the sheet plane of FIG. 3, which is a direction equivalent to a width direction of the developing roller 51, that is, an axial direction thereof. In other words, this direction is equivalent to a width direction of the photoreceptor drum 20, which is parallel to the axial direction.

Although not illustrated, the developing roller 51 includes a magnet roller, serving as a magnetic field generator, and a non-magnetic developing sleeve including the magnet roller therein and driven in the direction of arrow C1 in the counterclockwise direction by the developing roller drive mechanism.

The magnet roller, not illustrated, includes a plastic roller secured to the casing 55, and a magnet block including a plurality of magnets embedded to the plastic roller so as to form a plurality of magnetic poles.

The developing sleeve is rotatably supported by the casing 55 and the magnet roller. The bias applicator supplies an appropriate developing bias between the developing sleeve and the photoreceptor drum 20.

A gap between the developing sleeve and the photoreceptor drum 20 in the developing region is configured to be approximately 0.3 mm, for example.

The developing blade 52 is formed of SUS material. A gap, a so-called doctor gap between the developing blade 52 and the developing sleeve, is configured to be approximately 0.5 mm, for example.

The first conveyance screw 53 and the second conveyance screw 54 are extendedly provided in a direction perpendicular to the sheet plane of FIG. 3 which is the width direction of the developing roller 51, that is, a direction equivalent to a longitudinal direction of the developing roller 51.

The first conveyance screw 53 includes a shaft 53*a*. The second conveyance screw 54 includes a shaft 54*a*. The shaft 53*a* and the shaft 54*a* are rotated by the conveyance screw drive mechanism.

Each of the surfaces of the shaft 53*a* and the shaft 54*a* includes a paddle portion 53*b* and a paddle portion 54*b*, respectively. Each of the paddle portion 53*b* and the paddle portion 54*b* transports the developer while the developer is agitated as the shaft 53*a* and the shaft 54*a* rotate.

Each of the paddle 53*b* and the paddle 54*b* is integrally molded with the surface of the shaft 53*a* and the shaft 54*a*, in particular, the peripheral surface of the shaft 53*a* and 54*a* in a projecting manner.

According to the illustrative embodiment, the paddle portion 53*b* and the paddle portion 54*b* are formed in a spiral. Alternatively, the paddle portion 53*b* and the paddle portion 54*b* may be formed with a swash plate slanting relative to the shaft 53*a*.

The first conveyance screw 53 is disposed in the vicinity of the developing roller 51 facing the developing roller 51 and rotated in the direction of arrow D1 by the conveyance drive mechanism, thereby transporting the developer in a first developer chamber 58 from the front side of the sheet plane of FIG. 3 to the rear side thereof along the width direction of the developing roller 51 while supplying the developer to the developing roller 51.

Subsequently, the developer transported to the vicinity of the end portion of the first developer chamber 58 by the first conveyance screw 53 advances to a second chamber 59 through an opening, not shown, formed at the rear end portion of a separation wall 57 in FIG. 3. Accordingly, the developer is transported to the second conveyance screw 54.

The second conveyance screw 54 is disposed in the second chamber 59, substantially opposite the developing roller 51 via the first conveyance screw 53.

In the second chamber 59, the second conveyance screw 54 is rotated in a direction of arrow E1 by the conveyance drive mechanism, thereby transporting the developer transported from the first developer chamber 58 in the direction opposite the first conveyance screw 53 along the width direction of the developing roller 51.

It is to be noted that the front end portion of the separating wall 57 of FIG. 3 is integrally formed with the casing 55 and has no opening.

Referring back to FIG. 2, the casing 55 includes a developer receiving portion 86 connecting to the first developer chamber 58 at a location substantially corresponding to the front side of the sheet plane of FIG. 3. The developer receiving portion 86 serves as an inlet that receives the developer agitated by the agitation unit 82.

As illustrated in FIG. 2, the casing 55 includes a developer discharge portion 87 so as to connect to the second chamber 59. The developer discharge portion 87 serves as an outlet from which the developer transported to the front side of the second chamber 59 of FIG. 3 by the second conveyance screw 54 is discharged to the agitation unit 82.

In FIG. 2, the homeward path 84 is configured to connect the agitation unit 82 with the developer receiving portion 86. The outward path 85 is configured connect the agitation unit 82 with the developer discharge portion 87.

Accordingly, the developer transported along the homeward path 84 advances to the developing device 81 from the developer receiving portion 86, and then advances to the first developer chamber 58 via the developer receiving portion 86, arriving at the first conveyance screw 53.

The developer transported by the second conveyance screw 54 to the vicinity of the front side of the second chamber 59 of FIG. 3 advances to the outward path 85 from the developer discharge portion 87.

The outward path 85 includes a tube member 88 and a connector 89. The tube member 88 hangs from the developer discharge portion 87.

The connector 89 is connected to the bottom end of the tube member 88 and directly connected to the agitation unit 82. The connector 89 connected to the outward path 85 is configured to receive the fresh toner supplied from the toner supply device 79. In other words, the fresh toner is supplied from the toner supply device 79 at a position between the developer discharge portion 87 and the agitation unit 82.

The tube member 88 is formed of a tube including flexible material, such as rubber or a rubber tube. The tube member 88 is hollow inside thereof, thereby allowing the developer discharged from the developer discharge portion 87 to fall freely and advance to the direct connector 89.

The upper end of the connector 89 is connected to the tube member 88. The connector 89 is formed of a rigid pipe, one lateral side of which is connected to the toner supply device 79.

The homeward path 84 includes a rotary feeder 90 and a conveyance device 92. The rotary feeder 90 is connected to the agitation unit 82 and configured to store the developer temporarily and feed the developer which has been agitated and discharged from the agitation unit 82.

The conveyance device 92 is connected to the rotary feeder 90 and configured to transport the developer fed from the rotary feeder 90 to the developer receiving portion 86.

The conveyance device 92 includes a tube 92*a*, a tube joint 92*c*, and an air pump 101. The tube 92*a* is formed of flexible material such as a rubber tube or the like, and one end thereof is connected to the developer receiving portion 86.

The other end of the tube 92*a* is connected to the tube joint 92*c*. Substantially the center of the tube joint 92*c* is connected to the rotary feeder 90. The other end of the tube joint 92*c* is connected to the air pump 101.

The air pump 101 serves as an airflow generator that generates airflow to transport the developer advanced to the tube joint 92*c* from the rotary feeder 90 to the developing device 81 through the tube 92*a*.

It is to be noted that, as illustrated in FIG. 1, the air pump 101 is provided to each of the developing stations 50Y, 50M, 50C, and 50BK, and illustrated as an air pump 101Y, an air pump 101M, an air pump 101C, and an air pump 101BK.

Figure 4A:
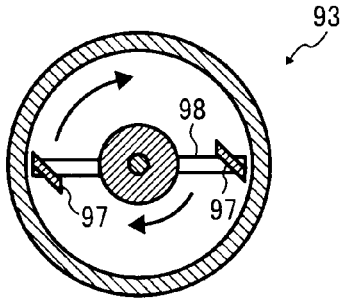
FIG. 4A is a cross-sectional view illustrating an internal structure of an agitation device of an agitation unit in the developing station as viewed from the top according to an illustrative embodiment of the present invention.
Figure 4B:
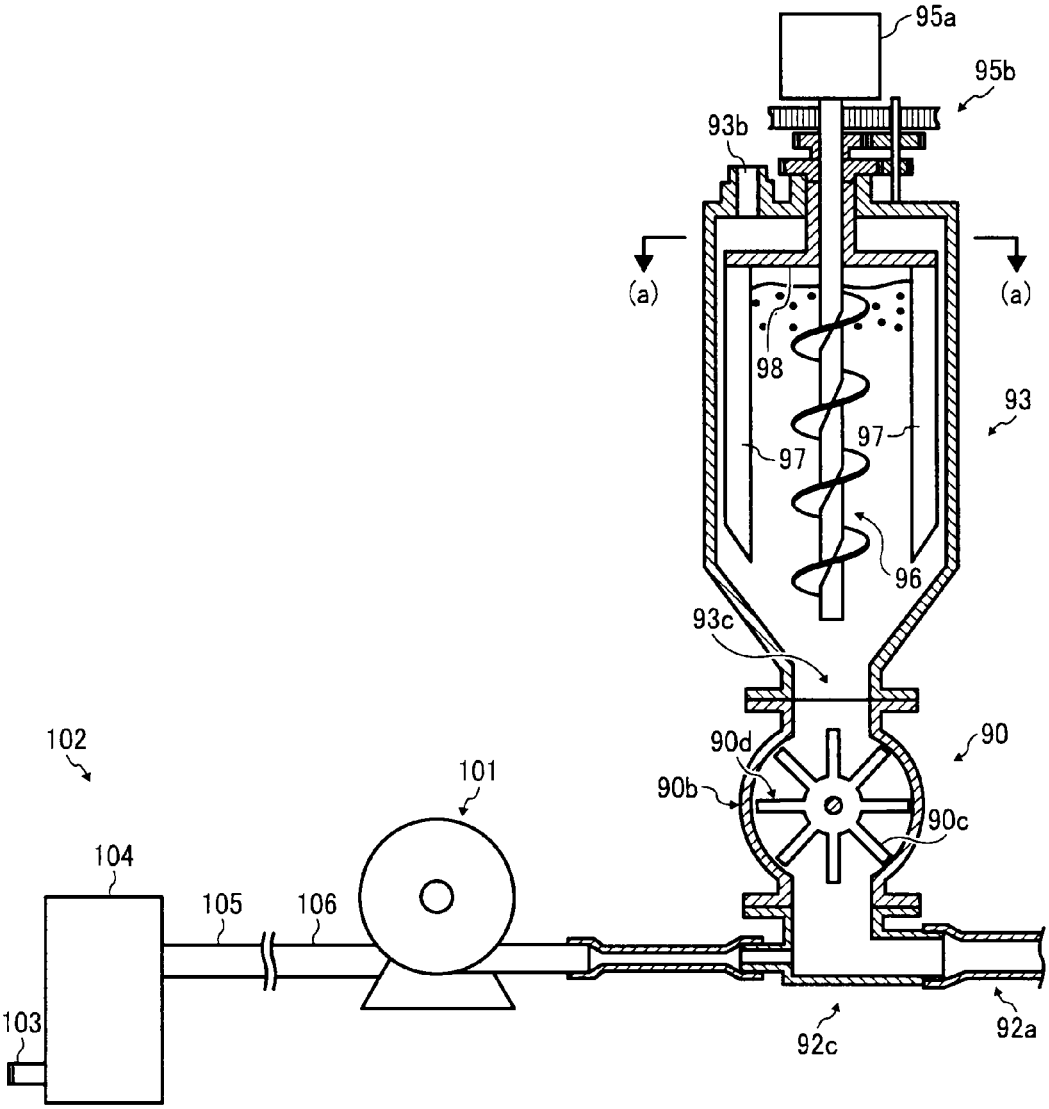
FIG. 4B is a cross-sectional view illustrating an internal structure of the agitation device of the agitation unit in the developing station according to an illustrative embodiment of the present invention.

Referring now to FIGS. 4A and 4B, there is provided a cross-sectional view illustrating the agitation device 93. As illustrated in FIG. 4B, the agitation device 93 includes a developer supply opening 93*b* and a developer discharge opening 93*c*.

The developer supply opening 93*b* is provided to substantially the upper surface of the agitation device 93. The developer discharge opening 93*c* is provided to substantially the bottom of the agitation device 93. The agitation device 93 has a substantially inverted conical shape, the diameter of which is reduced toward the developer discharge opening 93*c*.

A screw 96 is provided in substantially the center of the agitation device 93 and configured to transport the developer from substantially the bottom of the agitation device 93 to the upper portion thereof. Two agitation members 97 are rotatably provided at substantially the side of the screw 96. When the screw 96 and the agitation members 97 rotate, the developer is agitated and stirred.

The screw 96 and the agitation members 97 are rotated by the motor 95*a*. The screw 96 is directly connected to the motor 95*a*. The agitation members 97 are rotated through the reduction gear array 95*b*.

As illustrated in FIG. 4A, the agitation members 97 are fixed obliquely to a support member 98 that is directly connected to the reduction gear array 95*b*.

The developer is transported from the developer supply opening 93*b* to the developer discharge opening 93*c* with gravity. The agitation device 93 serves as a buffer and contains the developer inside thereof.

Accordingly, it is made possible to transport a consistent amount of the developer and stabilize an amount of air between developer particles so as to maintain a consistent density of the height of the developer and prevent unevenness in the amount of the developer advancing to the conveyance device 92.

In such an agitation device 93, the developer moves upward from substantially the bottom thereof as the screw 96 rotates. Further, along with the rotation of the agitation members 97 that rotate outside the screw 96, the developer moves downward as well as toward the screw 96, and then the developer is again driven upward from the bottom of the agitation device 93 by the rotation of the screw 96.

Convection of the developer occurs consistently in the agitation device 93, thereby enabling the agitation device 93 to agitate thoroughly all the developer.

The toner is charged through friction of the toner with the carrier. In order to achieve a desirable charge amount in a short period of time, it is important to increase a probability of contact between the toner and the carrier. According to the illustrative embodiment, the agitation device 93 generates convection of the developer, thereby increasing the probability that the toner will contact the carrier with less damage to the developer.

The rotary feeder 90 is rotated by a motor 90*a* shown in FIG. 2. As illustrated in FIG. 4B, the rotary feeder 90 includes a rotor 90*d* and a stator 90*b* that covers the rotor 90*d*.

The rotor 90*d* includes a plurality of blade members 90*c* extending radially. The rotary feeder 90 is configured to discharge a constant amount of the developer.

As described above, the tube 92*a* is hollow inside. The air pump 101 pumps the developer advancing into the tube joint 92*c* from the rotary feeder 90, thereby causing the developer to move inside the tube 92*a* and be supplied to the developer receiving portion 86.

According to the illustrative embodiment, the air pump 101 is a diaphragm pump. It is to be noted, however, that the air pump 101 is not limited to a diaphragm pump. Alternatively, the air pump 101 may be one using a butterfly valve, a rotary valve, or any other suitable type of air pump that may generate airflow by which the developer is transported to the developing device 81 through the tube 92*a*.

Referring back to FIG. 2, the toner supply device 79 includes a pipe 79*a* having a helical coil inside thereof, not shown, and a motor 79*b*. One end of the pipe 79*a* is connected to the connector 89. The toner bottle 9 is detachably provided to the pipe 79*a*.

The helical coil rotates in a predetermined direction so as to transport the developer released from the toner bottle 9 into the pipe 79*a* to the direct connector 89.

The motor 79*b* is connected to the other end of the pipe 79*a*, and the operation thereof is controlled by the controller. The motor 79*b* drives the coil to rotate in a predetermined direction.

The coil is rotated at a constant speed by the motor 79*b* such that a constant amount of the fresh toner is transported per unit of drive time, and the fresh toner transported to one end of the pipe 79*a* falls freely from the connector 89 and then advances into the agitation device 93.

In the developing station 50 according to the illustrative embodiment, the toner is evenly dispersed by the agitation unit 82, and the developer is charged properly for development. The appropriate amount of the charged developer is transported by the homeward path 84 and supplied from the developer supply opening 86 to the developing device 81.

In the developing device 81, the developer is transported from the developer receiving portion 86 along the developing roller 51 by the rotation of the first conveyance screw 53 while the developer is supplied to and borne on the surface of the developing roller 51 by the magnet roller.

The developing blade 52 regulates the amount of the developer to be borne on the surface of the developing roller 51. That is, the developing blade 52 regulates the thickness of the developer layer borne on the surface of the developing roller 51.

Through rotation of the developing roller 51 and the developing bias supplied by the bias applicator, the developing roller 51 carries the developer, the amount of which is regulated by the developing blade 52, to a developing region between the developing roller 51 and the photoreceptor drum 20.

In the developing region, the magnet roller forms a magnetic brush with the developer on the developing sleeve. Due to the bias applied by the bias applicator, the development potential acts on the toner at the front end of the magnetic brush, thereby electrostatically transferring the toner from the surface of the magnetic carrier to the electrostatic latent image formed on the surface of the photoreceptor drum 20. Accordingly, the electrostatic latent image is developed to a visible toner image of a predetermined color.

It is to be noted that charging of the toner can also be enhanced when the thickness of the developer layer is regulated by the developing blade 52. Thus, even if the amount of charge on the toner is reduced undesirably during transport of the developer from the agitation unit 82 to the developing device, the lost charge can be supplied.

The developer, from which the toner is consumed during development, is recovered to the first developer chamber 58 as the developing roller 51 rotates. When the first conveyance screw 53 rotates, the developer transported to the end portion of the first developer chamber 58 advances to the second developer chamber 59 through the opening of the separating wall 57 and arrives at the second conveyance screw 54.

Subsequently, in the second developer chamber 59, the second conveyance screw 54 transports the developer in the opposite direction as that of the first conveyance screw 53. The developer transported to the end portion of the second developer chamber 59 is discharged outside the developing device 81 from the developer discharge portion 87 and advances to the agitation unit 82 through the outward path 85.

As described above, in the developing device 81, the developer is agitated and transported by the first conveyance screw 53 and the second conveyance screw 54. Due to the magnetic force of the magnet roller, the developer is then supplied to and borne by the developing sleeve. Subsequently, the developer is transported to the developing region across from the photoreceptor drum 20 where the toner is supplied to the latent image on the photoreceptor drum 20.

After development, the developer, from which the toner is consumed, is released from the surface of the developing sleeve into the first developer chamber 58 and advances to the agitation unit 82 through the outward path 85.

In the agitation unit 82, the developer is made developable and then supplied to the developing device 81 and to the surface of the developing sleeve again. The magnet block is arranged so as to be able to perform the above-described development cycle repeatedly.

In such a development cycle, the toner in the developer is consumed, thus reducing the toner density. The toner density detector 56 detects decrease in the toner concentration. When the toner density detector 56 detects decrease in the toner density, the controller enables the toner supply device 79 to supply the new toner from the toner bottle 9 to the agitation unit 82 through the outward path 85.

The agitation device 93 agitates and stirs the newly supplied toner with the developer. The new toner is dispersed in the existing developer in the developing station 50. When the new toner is agitated and stirred with the carrier and other toner particles, the new toner is frictionally charged. Accordingly, the new toner is evenly dispersed and mixed with the existing developer in the agitation unit 82 while being charged properly for development.

Through feedback control or feedforward control by which the toner supply device 79 is operated for a predetermined time, the toner density of the developer is regulated to be in a range of approximately 4 to 11 wt % so that an appropriate mixing ratio of the toner relative to the carrier is consistently maintained, thereby making it possible to achieve better imaging quality.

Assuming that the air pump 101 draws air from the main structure 99, when the temperature of the air in the main structure 99 is relatively high, the temperature of the developer to be transported to the developing device 81 rises, thereby changing the characteristics of the developer and thus causing problems such as reduction in fluidity of the developer, accumulation of developer particles, and so forth that cause deterioration of developability and thus deterioration of imaging quality.

The optical scanner 8, the fixing device 6, and other motors generate heat, causing the temperature in the main structure 99 to rise easily and exceed the external temperature. Further, in the developing station 50, frictional heat generated between the developer particles during agitation or between the developer and other members also causes the temperature of the developer to rise easily. Still further, when the developing sleeve rotates around the magnet roller at a relatively high speed, an eddy current is generated, thereby generating heat and causing the temperature of the developer to rise as well. Consequently, the temperature of the developer rises in the main structure 99.

In particular, in the image forming apparatus 100, the developing station 50 is disposed substantially directly above the optical scanner 8. Consequently, the developer is affected easily by heat generated by the optical scanner 8, thereby also causing the temperature of the developer to rise.

In view of the above, as illustrated in FIGS. 1, 2, and 4, the image forming apparatus 100 according to the illustrative embodiment includes an air intake unit 102. The air intake unit 102 serves as an external air suction mechanism that connects the outside of the main structure 99 and the air pump 101, that is, the air pumps 101Y, 101M, 101C, and 101BK, so that air outside the main structure 99, the temperature of which is likely to be lower than that of the air inside the main structure 99, is drawn from outside and supplied to the air pumps 101Y, 101M, 101C, and 101BK.

The air intake unit 102 includes an air intake member 103 and a dehumidifier 104. The air intake member 103 is a pipe and forms an inlet that draws air from outside the main structure 99. One end of the air intake member 103 is provided to the main structure 99, and more specifically, the one end thereof is disposed immediately inside an opening of an external cover of the main structure 99 and exposed to the outside.

The other end of the air intake member 103 is connected to the dehumidifier 104 serving as a dehumidifying mechanism that dehumidifies the air drawn from outside the main structure 99 and supplies the air to the air pumps 101Y, 101M, 101C, and 101BK.

The air intake unit 102 includes a main duct 105 and tubes 106Y, 106M, 106C, 106BK branching from the main duct 105, each of which is connected to the air pumps 101Y, 101M, 101C, and 101BK, respectively. The main duct 105 is shared with the developing stations 50Y, 50M, 50C, and 50BK. It is to be noted that, with respect to tubes 106Y, 106M, 106C, 106BK, the reference characters Y, M, C, and BK indicating colors are omitted, but simply indicated as 106 in FIGS. 2 and 4.

Figure 5C:
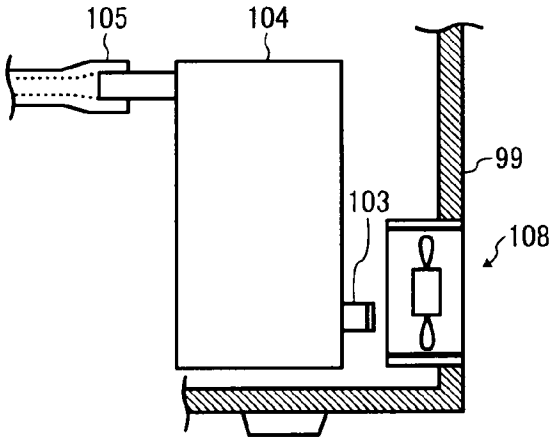
FIG. 5C is a schematic side view illustrating a portion of the air intake device of the image forming apparatus of FIG. 1 according to still another illustrative embodiment of the present invention.
Figure 5B:
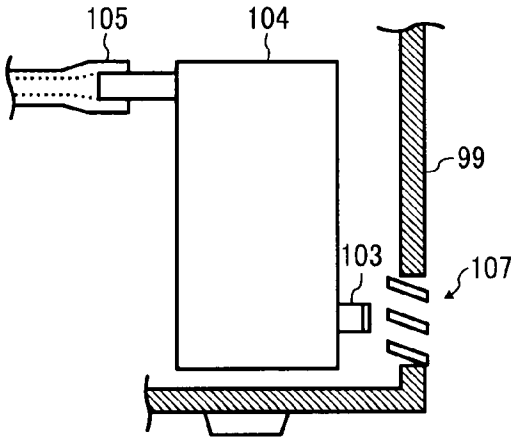
FIG. 5B is a schematic side view illustrating a portion of the air intake device of the image forming apparatus of FIG. 1 according to another illustrative embodiment of the present invention.
Figure 5A:
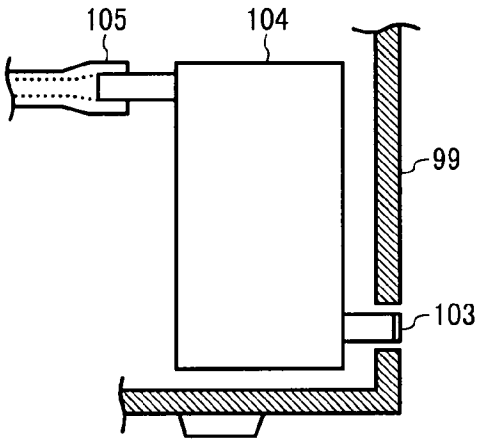
FIG. 5A is a schematic side view illustrating a portion of an air intake device of the image forming apparatus of FIG. 1 according to an illustrative embodiment of the present invention.

Referring now to FIG. 5A, there is provided a side view illustrating a portion of the air intake mechanism according to the illustrative embodiment. As illustrated in FIG. 5A, the air intake member 103 is disposed substantially at the bottom of the main structure 99 from which the air outside the main structure can be drawn inside. Accordingly, cooler air that resides near the bottom, that is, near the floor on which the image forming apparatus 100 is generally placed, can be drawn inside.

The temperature of the air near the floor tends to be lower than the air in other parts. Further, the air drawn inside passes a position in the main structure 99 the temperature of which tends to be also lower than other parts of the main structure 99, so that the cooler air can be directed inside.

For the same reason, the dehumidifier 104 is provided substantially at the bottom of the main structure 99. The humidifier 104 includes silica-gel serving as a desiccant filling in a space where the air drawn from the air intake member 103 passes.

Using the silica-gel, the air drawn from outside the main structure 99 through the air intake member 103 is dehumidified. Accordingly, without a dedicated drive source, moisture in the air drawn inside can be removed with a relatively simple configuration and at low cost, preventing the developer from becoming moist and thus preventing deterioration of charging ability. The charging ability can be reliably maintained.

It is to be noted that, according to the illustrative embodiment, the silica-gel is used as desiccant because of its availability and relatively low price. However, the desiccant is not limited to silica-gel, and alternatively another suitable desiccant may be used.

The main duct 105 and the tube 106 are formed of a hollow tube made of flexible material, thereby facilitating handling of the main duct 105 and the tube 106 as well as the air intake member 103 and the dehumidifier 104.

When the air pump 101 pumps air, generating airflow that pushes the developer to the developing device 81, a negative pressure is generated due to reaction of the airflow, thereby drawing ambient air from outside the main structure through the air intake member 103, the dehumidifier 104, the main duct 105, and the tube 106.

Each of the components of the air intake device 102 is preferably covered with a cover member including heat insulating material so as to prevent the temperature of the air drawn from outside the main structure 99 from rising when the air circulates inside the main structure 99.

The toner bottle 9, the tube member 88, the tube 92*a*, the tube joint 92*c*, and so forth are preferably covered with the heat insulating member as well. In particular, the main duct 105 and the tube 106 are preferably covered with the heat insulating member since the main duct 105 and the tube 106 are installed in the vicinity of the optical scanner 8 that generates heat. Thus, significant heat insulating effect can be obtained.

The air intake device 102 enables the air pump 101 to pump the air, the temperature of which is relatively low. By contrast, generally, the temperature of the developer in the developing station 50 and the toner in the toner bottle 9 is relatively higher than the external temperature due to the heat in the main structure 99.

The developer transported by the airflow formed by the air pump 101 is cooled to a temperature substantially similar to the external temperature and advances to the developing device 81. Accordingly, the temperature of the developer in the developing device 81 can be maintained relatively low, thereby facilitating development of the photoreceptor drum 20 using the developer.

It is to be noted that, preferably, one end of the air intake member 103 includes a filter or the like such as a mesh filter to prevent foreign substances, for example, dust, from getting inside.

Referring now to FIG. 5B, there is provided a side view illustrating an alternative embodiment of the present invention. As illustrated in FIG. 5B, the air intake device 102 may include a louver 107 that is exposed outside the main structure 99 and serves as a dust protector to prevent foreign substances from getting inside the air intake device 102. The air intake member 103 may draw air from outside the main structure 99 through the louver 107.

A louver is often provided to the image forming apparatus 100. Thus, the louver provided to the image forming apparatus 100 may be used as the louver 107 to prevent foreign substances from getting inside the air intake device 102.

Referring now to FIG. 5C, there is provided a side view illustrating another alternative embodiment of the present invention. As illustrated in FIG. 5C, the air intake device 102 may include a fan 108 serving as an air feed mechanism configured to feed air from outside the main structure 99 into the main structure 99. The air intake member 103 draws the air supplied inside the main structure 99 through the fan 108.

A fan is often provided to the image forming apparatus 100. Thus, the fan provided to the image forming apparatus 100 may be used as the fan 108, and thus it is not necessary to provide separately a dedicated fan, thereby reducing the load on the air pump 101 to form the airflow. Alternatively, the fan 108 serving as the air feed mechanism may be used with the louver 107 serving as the dust protector.

The foregoing description pertains to the exemplary aspects of the present invention. It is to be noted that, however, the present invention is not limited to the particular embodiments described above.

Furthermore, elements and/or features of different illustrative embodiments may be combined with each other and/or substituted for each other within the scope of this disclosure and appended claims.

Thus, for example, the air intake device 102 need not be limited to the illustrative embodiments described above. Alternatively, the air intake device 102 may be provided to each of the developing stations 50.

The air pumps 101 serving as the airflow generator need not be provided to each of the developing devices. Alternatively, a single air pump may be used as the airflow generator and shared with all of the developing devices. In this case, it is preferable to direct the airflow generated by the airflow generator only to the developing device(s) that need(s) to transport the developer. Therefore, it is desirable to provide an airflow switching mechanism such as a solenoid valve or the like that can switch paths of the airflow formed by the airflow generator depending on the developing device to transport the developer.

The developer according to the illustrative embodiment need not be limited to a two-component developer, but may instead be a single-component developer. In this case, a similar if not the same developing station and agitation unit according to the illustrative embodiments can be used.

According to the above-described illustrative embodiments, the new toner is supplied at a location immediately before the agitation unit 82. Alternatively, the fresh toner may be supplied directly to the agitation unit 82.

At least a portion of the first channel forming device or the homeward path 84, the second channel forming device or the outward path 85, and a portion of the air intake device 102 may include flexible material such as a flexible tube.

When the flexible tube member is employed for a connecting portion of the devices connected to the developing station and a connecting portion of the air intake device 102 connected to the airflow generator, the developing station and the airflow generator can be detached with ease, thereby facilitating maintenance.

According to the above-described illustrative embodiments, in the developing station 50, the bias applicator supplies the developing sleeve with the developing bias of a direct current. Alternatively, the developing bias may be of an alternating current, or alternating current superimposed on a direct current.

The exemplary aspects of the present invention are implemented in a tandem-type image forming apparatus. Alternatively, the exemplary aspects of the present invention may be implemented in a single-drum type image forming apparatus, in which toner images in different colors are formed on a single photoreceptor drum and are superimposed on one another, forming a composite color image.

Further, the exemplary aspects of the present invention may be implemented in a color image forming apparatus as well as a monochrome image forming apparatus. In either type of the image forming apparatuses, no intermediate transfer medium may be used. Alternatively, the toner images of different colors are directly transferred onto a transfer medium or the like.

Furthermore, elements and/or features of different illustrative embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. An image forming apparatus for developing a latent image on an image bearing member, comprising:

the image bearing member configured to bear the latent image on the surface thereof;

a plurality of developing devices, each developing device configured to form an image from a different color of developer than other developing devices;

a plurality of agitation devices configured to agitate developer, each agitation device including a screw configured to rotate around a vertical axis and a rotor configured to rotate around a horizontal axis, each agitation device providing toner to a corresponding developing device;

a plurality of airflow generators, each airflow generator configured to generate airflow to transport a corresponding color of developer to a corresponding developing station, each airflow generator configured to supply airflow to an output of the rotor of a corresponding agitation device to transport developer from the output of the rotor to the corresponding developing device;

a single dehumidifier to dehumidify the air drawn only from outside the image forming apparatus; and an air intake device configured to connect outside the image forming apparatus with each airflow generator to draw air only from outside the image forming apparatus to supply the air to each airflow generator, the air intake device including continuous passages from the single dehumidifier to each of the plurality of airflow generators such that no air from inside the image forming apparatus is supplied to any of the plurality of airflow generators.

2. The image forming apparatus according to claim 1, wherein the dehumidifier is silica-gel.

3. The image forming apparatus according to claim 1, wherein the air intake device is configured to draw air outside the image forming apparatus from substantially the bottom of the image forming apparatus.

4. The image forming apparatus according to claim 1, wherein the air intake device includes an inlet, a portion of which is exposed outside the image forming apparatus and from which air outside the image forming apparatus is drawn inside thereof.

5. The image forming apparatus according to claim 1, wherein the air intake device further comprises a louver exposed outside the image forming apparatus, and an inlet from which air is drawn from outside the image forming apparatus via the louver.

6. The image forming apparatus according to claim 1, wherein the air intake device further comprises an air feed mechanism configured to feed air from outside the image forming apparatus to inside thereof, and an inlet from which air is drawn from outside the image forming apparatus via the air intake device.

7. A method for developing a latent image on an image bearing member with a developer in an image forming apparatus, the method comprising:

bearing a latent image on a surface of an image bearing member;

agitating developer using an agitating device including a screw configured to rotate around a vertical axis and a rotor configured to rotate around a horizontal axis;

forming an image from a different color of developer at each of a plurality of developing devices;

generating airflow using a plurality of airflow generators to transport developer to each developing device, the generating including supplying airflow to an output of the rotor of the agitating device to transport developer from the output of the rotor to a corresponding developing device;

drawing air only from outside the image forming apparatus;

dehumidifying the air drawn only from outside the image forming apparatus;

supplying dehumidified air to each airflow generator using continuous passages from a single dehumidifier to each of the plurality of airflow generators such that no air from inside the image forming apparatus is supplied to any of the plurality of airflow generators.

8. The method according to claim 7, wherein silica-gel is used for the dehumidifying.

9. The method according to claim 7, wherein the air is drawn from substantially the bottom of the image forming apparatus.

10. The method according to claim 7, wherein the air is drawn from outside the image forming apparatus through an inlet, a portion of which is exposed outside the image forming apparatus.

11. The method according to claim 7, wherein the air is drawn from outside the image forming apparatus through an inlet via a louver that is exposed outside the image forming apparatus.

12. The method according to claim 7, wherein the air is fed from outside the image forming apparatus into the image forming apparatus via an inlet by an air feed mechanism.

13. The method of claim 7, wherein the image forming apparatus comprises:

an image bearing member configured to bear the latent image on the surface thereof;

a plurality of developing devices, each developing device configured to form an image from a different color of developer than other developing devices;

a plurality of airflow generators, each airflow generator configured to generate airflow to transport a corresponding color of developer to a corresponding developing station;

a single dehumidifier to dehumidify the air drawn only from outside the image forming apparatus; and an air intake device configured to connect outside the image forming apparatus with the airflow generator to draw air only from outside the image forming apparatus to supply the air to each airflow generator, the air intake device including continuous passages from the single dehumidifier to each of the plurality of airflow generators such that no air from inside the image forming apparatus is supplied to any of the plurality of airflow generators.

14. The method according to claim 7, further comprising:

transporting recycled developer from each developing device to the agitating device.

15. The image forming apparatus according to claim 1, wherein each agitation device includes a developer input configured to receive recycled developer from the corresponding developing device.

* * * * *